US006408766B1

(12) United States Patent
McLaughlin et al.

(10) Patent No.: US 6,408,766 B1
(45) Date of Patent: Jun. 25, 2002

(54) AUXILIARY DRIVE, FULL SERVICE LOCOMOTIVE TENDER

(76) Inventors: Edward M. McLaughlin, 975 E. Essex Ct. Way, #6, Midvale, UT (US) 84047; Michael D. Gordon, 3163 133rd Ave., Thornton, CO (US) 80241; Daniel L. Moore, 30373 Hilltop Dr., Evergreen, CO (US) 80439

( * ) Notice: Subject to any disclaimer, the term of this patent is extended or adjusted under 35 U.S.C. 154(b) by 0 days.

(21) Appl. No.: 09/344,262

(22) Filed: Jun. 25, 1999

(51) Int. Cl.[7] ..... B61C 17/02

(52) U.S. Cl. ..... 105/231; 105/27; 105/34.2; 105/236

(58) Field of Search ..... 105/27, 34.1, 34.2, 105/35, 73, 231, 236; 246/187 C, 182 B; 291/2, 25, 38

(56) References Cited

U.S. PATENT DOCUMENTS

| | | | | | |
|---|---|---|---|---|---|
| 606,237 | A | * | 6/1898 | Prescott | 105/73 |
| 681,760 | A | * | 9/1901 | Vanderbilt | 105/73 |
| 1,382,910 | A | * | 6/1921 | Herr | 291/25 |
| 1,395,476 | A | * | 11/1921 | Brown | 105/236 |
| 1,707,821 | A | * | 4/1929 | Stefani | 105/236 |
| 1,745,170 | A | * | 1/1930 | Kleinow | 105/231 |
| 2,339,844 | A | * | 1/1944 | Doerr | 105/236 |
| 3,835,788 | A | * | 9/1974 | Paul et al. | 105/182 E |
| 3,899,041 | A | * | 8/1975 | Mager | 180/65 R |
| 4,809,616 | A | * | 3/1989 | Peil | 105/73 |
| 4,867,072 | A | * | 9/1989 | Klein et al. | 105/133 |
| 5,353,413 | A | * | 10/1994 | Novakovich et al. | 395/325 |
| 5,777,547 | A | * | 7/1998 | Waldrop | 340/438 |

OTHER PUBLICATIONS

*Locomotive Auxiliary Fuel Tenders*, Quality Rail Services, LLC.

* cited by examiner

*Primary Examiner*—S. Joseph Morano
*Assistant Examiner*—Frantz F. Jules
(74) *Attorney, Agent, or Firm*—Thomas W. Hanson

(57) ABSTRACT

A long distance auxiliary drive tender for railroad locomotives which stores significant quantities of fuel and delivers the fuel to the locomotives while underway and which also includes traction motor drive axles powered by the locomotive generators. The traction motors are also capable of providing dynamic braking. Preferably, the auxiliary drive tender will also store and transfer lubrication oil, water, and sand for the locomotives. The auxiliary drive tender operates much like a B-unit in conventional MU operations except that it does not have its own power source.

15 Claims, 6 Drawing Sheets

AUXILIARY DRIVE, FULL SERVICE LOCOMOTIVE TENDER

FIELD OF THE INVENTION

The present invention relates to the field of locomotive tenders and specifically to such tenders which also incorporate drive axles powered by the attending locomotive(s).

BACKGROUND OF THE INVENTION

A recent change in locomotive design has enabled a new approach to long haul train operations. This approach provides new benefits by leveraging this change and addresses an age old problem. The enabling change is the switch from DC to AC power in locomotives. This resulted in increased efficiency with the result that the locomotives can now generate more power than they are able to make use of with a normal configuration of drive axles.

One approach to this surplus has been to increase the number of drive axles available by adding a third truck in the middle of the locomotive. See U.S. Pat. No. 4,231,296 to Jackson. This approach is complicated by the need for the middle truck to offset laterally as the locomotive transits a curve. It also requires a redesign of the locomotive and would then replace existing locomotives.

In switchyard applications a "slug" unit, or "cow and calf" arrangement has been used. The slug is a converted locomotive which has drive axles but no engine or generator. The electrical power for the slug is drawn from the attending engine. Ballast, usually concrete, replaces the engine to provide sufficient weight for traction. Traction sand hoppers spread sand for increased traction effort as on a traditional engine. In at least one application, the belly fuel tank was left on the slug and hose run to the locomotive to allow it to use the fuel from the slug. The slug is controllable from the lead locomotive as in conventional MU operations. This arrangement is most applicable to heavy hump yard switching service where the engine is frequently moving strings of cars from a standstill and up an incline (the hump) at low speeds.

The age old problem is that of not being able to carry enough fuel in the locomotive to make non-stop long haul trips. In addition to fuel, the locomotive must also be periodically re-supplied with lubricating oil, water, and traction sand. Lacking the necessary range, trains must make mid-trip fueling stops to re-supply. In a typical situation, the train will stop at a fixed fueling stop which is maintained for that purpose. The locomotive is uncoupled from the train and moved to a roundhouse or servicing area where it is fueled, serviced, and the oil, water and sand re-filled. It may take as much as 12 hours per stop to uncouple the locomotive, route it through the switchyard to the service area, route it back to the train, and recouple it. That is a significant loss of time for a trip which requires about 60 hours of time under way.

The necessity to maintain the fixed fueling stops is also a significant expense. The facilities themselves must be maintained. Personnel must be employed to run the fueling stop and perform the service and fueling. Fuel and other consumables must be purchased and stored. Fuel prices vary widely across the country. Because of the logistics enforced by the range of the locomotives, it may be necessary to maintain a fixed fueling stop in an area where fuel prices are much higher than elsewhere along the route. This means that either fuel must be purchased at the local rates or purchased elsewhere and transported in at additional expense.

At least one railway company, Union Pacific, has tested the concept of providing additional fuel for the locomotives.

A conventional tank car was converted to allow locomotives to draw fuel from the tank car while the train was underway. MU cabling was added to enable the locomotives to communicate as usual with the tank car positioned between them. The tank car itself did not utilize the MU signals. Running boards and handrails were removed as part of the modification, preventing the train crew from walking between the locomotives while the train was underway. No other consumables, such as lubrication oil, water or sand, was carried by the tank car. The modified tank cars, four total, were used for a short term test spanning a few months. While the concept was considered viable, the tank cars are no longer in use. A major drawback to this approach is the structural weakness of the tank car. It was not designed to become part of a locomotive consist where it is placed between two locomotives and subject to the stresses of locomotives under full power. Additional problems, such as the lack of walkways also restricted the utility.

There is a need for a supplemental unit which can serve a multi-part role in a locomotive consist. It should draw from the surplus power generated by the locomotives to supply additional tractive force via drive axles. Dynamic braking should also be available to assist in decelerating the train. The unit should carry sufficient additional fuel, lubrication oil, water, and sand to allow extended long haul trips to be made without stopping. It must also be able to transfer these materials to the locomotives on command while the train is underway. The design of the unit should be such that it fits seamlessly into a consist: standard MU cabling and command response; structural strength equivalent to a locomotive; walkways and handrails for crew movement; and symmetric coupling to allow connection to locomotives at both ends. Preferably this unit would work as a supplement to existing locomotives, requiring minimal locomotive modification, to protect the investment in the existing fleet.

SUMMARY OF THE INVENTION

The present invention is directed to an auxiliary drive tender which provides storage for fuel and other consumables, such as oil, sand and water, as well as traction motors and drive axles which supply both tractive force and dynamic braking.

According to the invention there is provided an auxiliary drive tender which has a frame and drive axles similar to a conventional locomotive while also storing a large quantity of fuel. The drive axles are powered by electricity from the locomotive and the fuel can be transferred to the locomotive while under way.

According to an aspect of the invention the auxiliary drive tender will also store and supply lubrication oil, water, and sand.

According to another aspect of the invention the traction motors also provide dynamic braking.

Further in accordance with the invention the traction motors, dynamic braking, fuel transfer, oil transfer, water transfer and sand transfer are all controlled from the lead locomotive via commands transmitted to the tender.

Still further in accordance with the invention, the auxiliary drive tender includes a power distribution circuit which connects to generators on two locomotives and distributes the power to the traction motors of the tender according to any of the following schemes: either locomotive generator may power all traction motors; each locomotive generator powers one set of traction motors for one truck; or the power of both locomotive generators is distributed to all traction motors.

The advantages of such an apparatus are that sufficient consumable supplies (fuel, oil, water, sand) are stored and transferred to the locomotive(s) while underway making it unnecessary to stop during a typical long haul trip. The traction motors and drive axles supplement both the tractive force available for moving the train and the dynamic braking force available for slowing the train. The design of the auxiliary drive tender is such that it fits into a conventional locomotive consist much like a conventional B-unit, simplifying train crew operations.

The above and other features and advantages of the present invention will become more clear from the detailed description of a specific illustrative embodiment thereof, presented below in conjunction with the accompanying drawings.

DETAILED DESCRIPTION OF THE INVENTION

The following discussion focuses on the preferred embodiment of the invention, in which an A/C powered auxiliary drive tender is used with a pair of attending locomotives. However, as will be recognized by those skilled in the art, the disclosed apparatus is applicable to a variety of situations in which a combination of auxiliary drive and/or dynamic braking in combination with increased provisioning of consumable materials for railroad or light rail use is desired.

The following is a brief glossary of terms used herein. The supplied definitions are applicable throughout this specification and the claims unless the term is dearly used in another manner.

B Unit—a conventional locomotive with engine, generators, and drive axles, but without a cab. A B-unit is intended to be controlled by the crew of the lead locomotive in MU operations.

Belly Tank—fuel tank which is generally slung under the frame of a locomotive between the trucks.

Consist—group of locomotives operated together as a unit.

DTL—Direct To Locomotive. Providing services such as loading fuel, sand, lubrication oil, and cooling water and off loading wastewater by taking a truck to the locomotive while it is still coupled to the train rather than uncoupling the locomotive and moving it to a roundhouse or servicing terminal.

Generator—generally any device capable of generating an electric current when driven by an external mechanism. As used herein, the term is intended to encompass devices which provide either DC or AC current, whether referred to in the art as a generator, alternator, or other term. For the purposes of the present invention, DC and AC current are generally equivalent.

Locomotive—generally a diesel electric railroad locomotive including an engine, generator, and traction motors. As used herein, it also includes similar prime mover devices in other rail applications such as for mass transit and foundry work.

MU—Multi-Unit. Refers both to the multiple locomotives of a consist and to the control lines which interconnect the locomotives to provide common control.

Pilot—the ends of a locomotive main frame consisting of the superstructure that surrounds the couplers.

Slug—A small, ballasted, four or six axle unit, semi-permanently coupled to a locomotive that does not have a prime mover, but does have traction motors. Generally used in yard duty where the switch engine has enough horsepower, but not enough tractive force to push long strings of cars up a hump.

Preferred Embodiment

The disclosed invention is described below with reference to the accompanying figures in which like reference numbers designate like parts.

Figure 1:
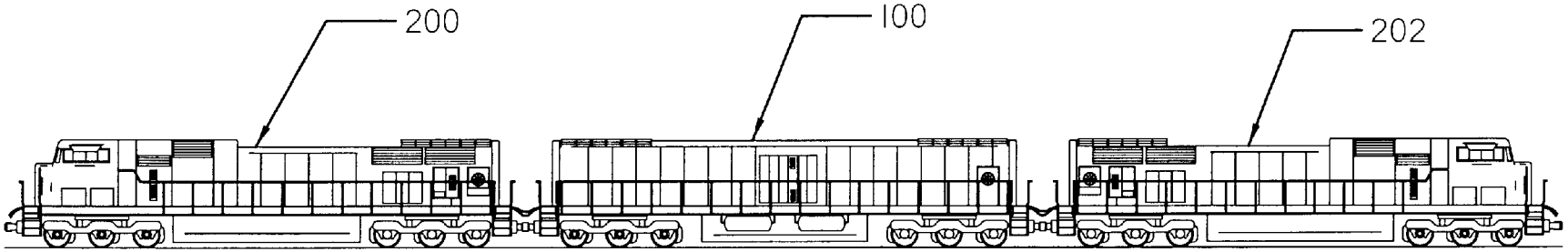
FIG. 1 illustrates the inventive auxiliary drive tender in its typical configuration with two attending locomotives.

FIG. 1 illustrates the auxiliary drive tender of the present invention, 100, as it would be used with two locomotives, 200 and 202, as part of a novel 3 unit consist which utilizes only two prime movers. Positioned between the two locomotives, the tender can provide fuel, lubrication oil, water, and sand to both locomotives simultaneously. However, the tender is also an active component of the consist. All of its axles are driven by traction motors which draw their electrical power from the generators on one or both locomotives. The motors can also provide dynamic braking to assist in slowing the train. In providing drive and braking assistance the inventive tender acts much like a conventional B-unit except that it does not have an engine or generator.

The auxiliary drive tender typically utilizes a frame and trucks from a conventional diesel electric locomotive. This provides a sufficiently strong foundation to allow the tender to withstand, and transfer, the drive forces applied by the adjacent engines and by its own traction motors. In the preferred embodiment, a General Electric MAR-70 or MAC-90 frame is used as the foundation for the tender. This provides a complete starting point including frame, trucks, belly tank, and associated systems, e.g. brakes, electrical circuits, fuel pumps, etc.

Figure 2:
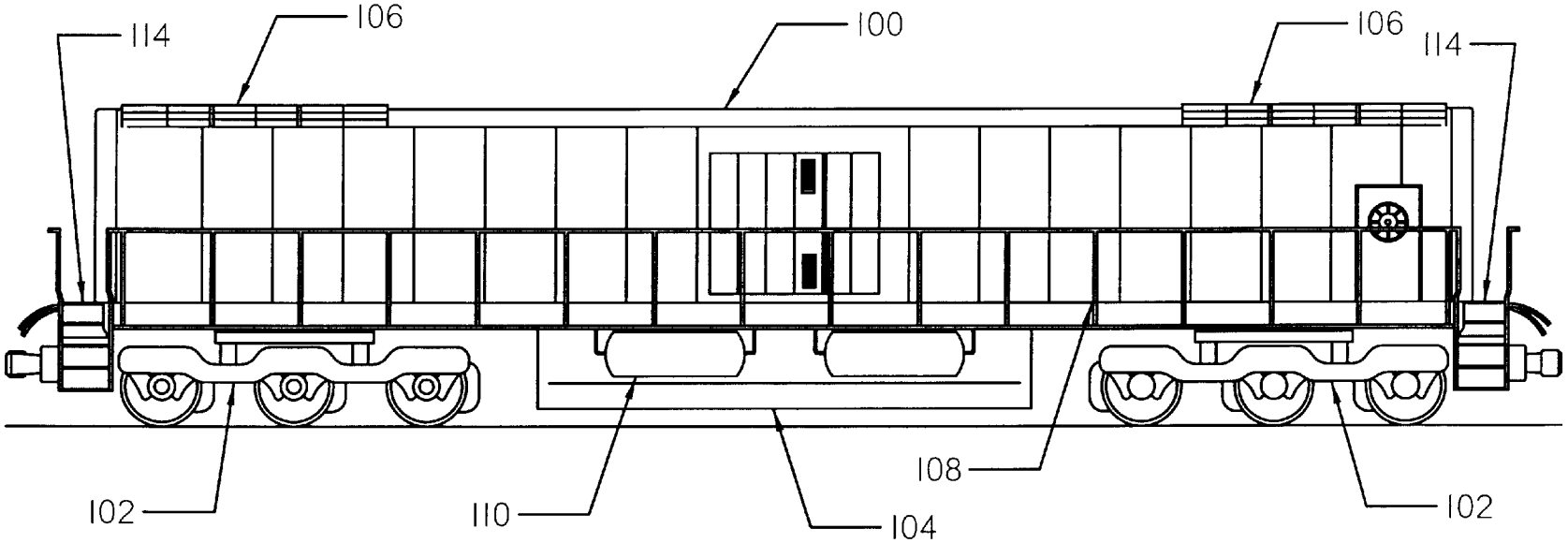
FIG. 2 is a side view of the auxiliary drive tender.

FIG. 2 provides a closer side view of the auxiliary drive tender, 100. In the preferred embodiment, the tender uses two three-axle trucks, 102, with all axles driven by traction motors. The traction motors are also connected to a conventional dynamic braking circuit which connects the motors to a bank of 700 ampere resistor grids located on top of the tender, below cooling fans, and under vents, 106. In dynamic braking mode, the motors generate electricity which is transmitted to the resistance grids and converted to heat which is dissipated through the vents. The generation of electricity creates a resistance against the traction motor coils and thereby causes a slowing in the rotation of the axles and wheels. Between the trucks are the belly tank, 104, and compressed air storage tanks, 110. At either end, adjacent the pilots, 114, are the couplers and connections for mating to the leading and following locomotives. Walkway and handrails, 108, connect the pilots, 114, at either end of the tender allowing the crew to safely move between the engines and to access the tender while the train is under way.

Figure 3:
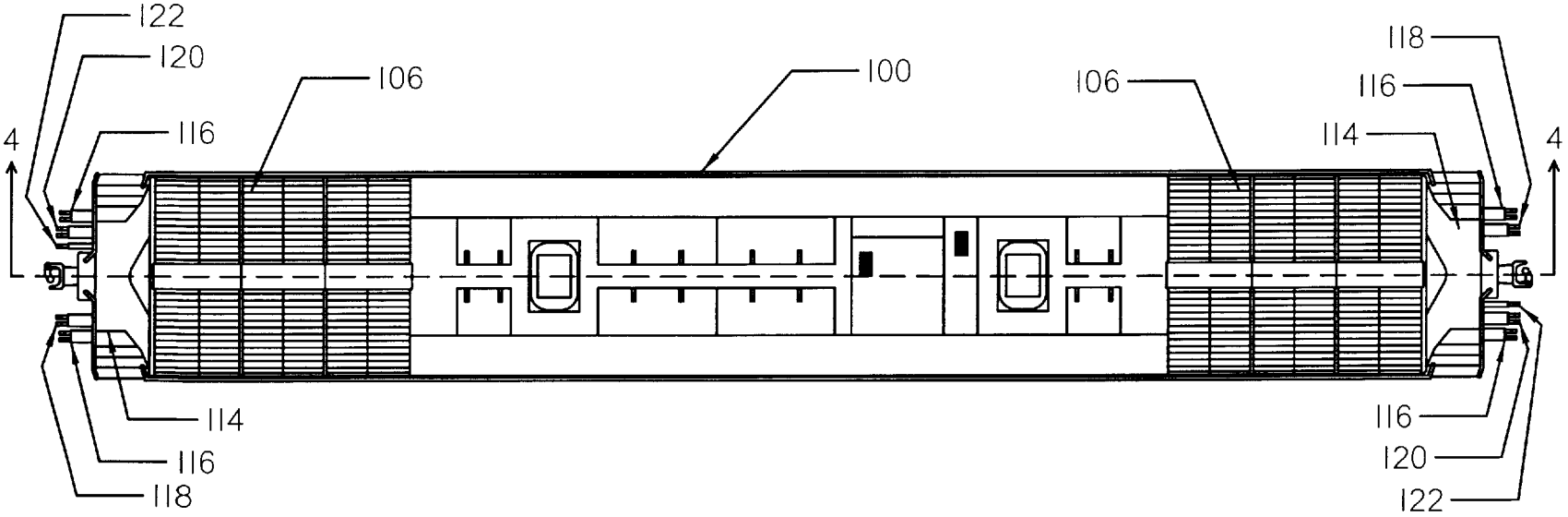
FIG. 3 is a top view of the auxiliary drive tender.

The top view, FIG. 3, provides a clearer view of the resistance grid vents, 106, and the pilots, 114. Also shown are the connections for transfer of sand, 116, diesel fuel, 118, water, 120, and lubrication oil, 122, between the tender and the locomotives. Additional connections are provided by conventional MU couplings as described below.

The functions of the auxiliary drive tender can be broken down into two broad categories: storage and transfer of materials; and auxiliary drive and braking. In its role as a long distance tender, the inventive device stores a variety of materials which are consumed by the locomotives and transfers them to the locomotives on demand. These materials include diesel fuel, sand, lubrication oil and water. Additionally the tender stores compressed air. While the air could be provided to the locomotives it is primarily for local use on the tender.

Storage

Figure 4:
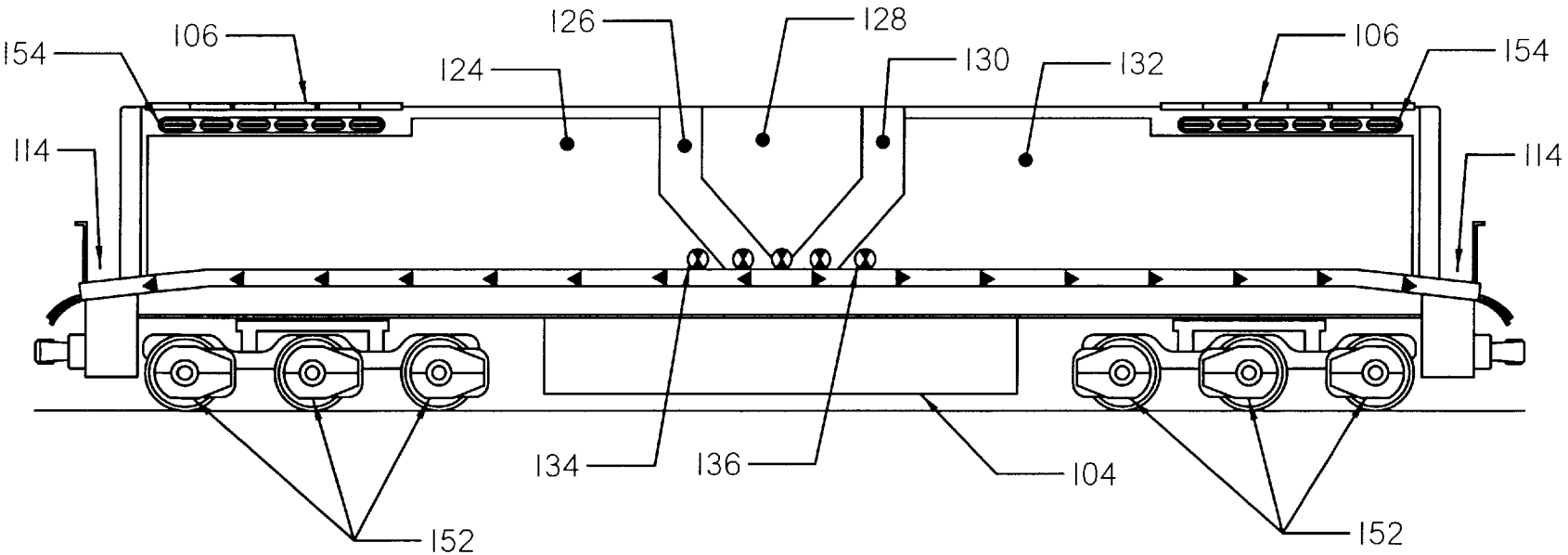
FIG. 4 is an interior view of the auxiliary drive tender illustrating the configuration of the storage tanks.
Figure 5:
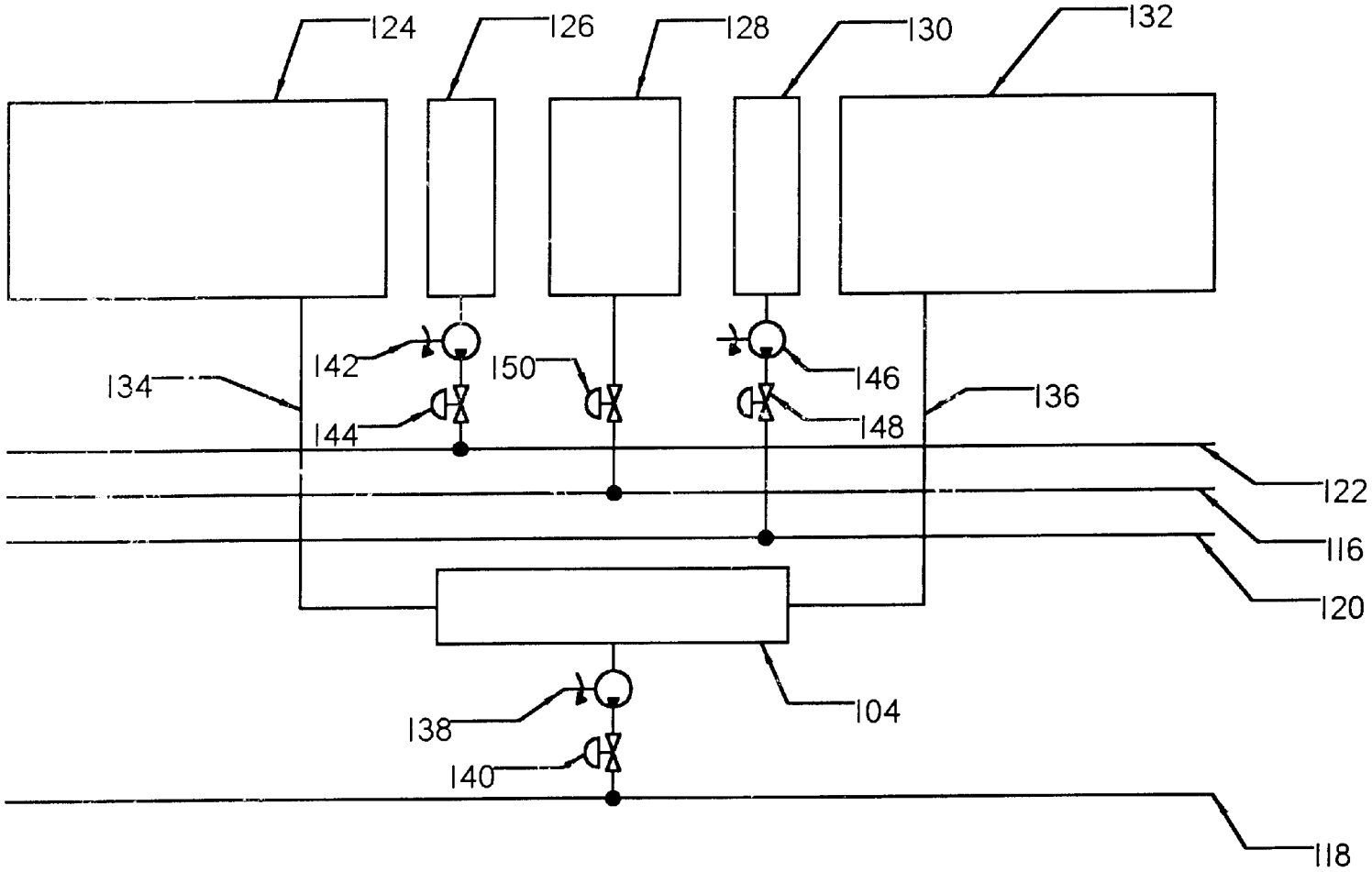
FIG. 5 is a block diagram of the storage tanks and associated connections.

FIG. 4 illustrates the storage configuration of the auxiliary drive tender as a cut away view. FIG. 5 illustrates the same configuration as a block diagram. References in the following discussion refer to both diagrams unless clearly to the contrary. The layout of the various tanks takes into consideration several factors including load distribution over the axles, transfer distances to the locomotives, and location of the fill connections. In the preferred embodiment this has led to a symmetric design with the smaller tanks located near the middle. This allows for all fill connections to be located in the same place, equal length transfer paths to both locomotives, and a mid-point location for the sand, which has the greatest density and is consumed the slowest, so that it is always evenly balanced between the trucks.

The diesel fuel is stored in three tanks. The two main tanks, 124 and 132, provide the majority of the storage capacity. The belly tank, 104, provides supplemental storage and serves as a sump for the fuel storage system. Fluid transfer lines, 134 and 136, connect the main storage tanks to the belly tank. While valves could be used to provide isolation of individual tanks, in operation the three tanks are connected by open lines. This results in the belly tank remaining full until both main tanks are drained. It also provides for gravity fed transfer of fuel from one main tank to the other via the belly tank providing automatic leveling the of the fuel in the two main tanks resulting in balanced load on the trucks. As the main tanks near empty, the sump function of the belly tank also provides a scavenging action. As the track grade varies, the fuel in a tank may move away from the tank outlet. In this situation, the locomotives will continue to draw from the belly tank. As the grade reverses, the fuel in the main tank will move back to the outlet and will drain into the belly tank. In this way, all of the fuel in the main tanks is useable with no interruption in supply and without need for multiple outlets, baffles, or other arrangements. In the preferred embodiment, each main tank has a single outlet at the interior end. Alternatively, additional outlets, such as at the exterior end could be added to improve draining or to compensate for sloped tanks. The three tanks combines provide approximately 21,200 gallons of fuel storage. This supplements the tanks on the locomotives to provide approximately 30,000 gallons total capacity. At a typical consumption rate of 2.5 gallons per mile, this yields a range of approximately 6,000 miles between refueling stops. As discussed below, this provides significant economic and logistical benefits.

The benefits provided by the increased range between refueling stops can only be realized if all other consumable supplies needed by the locomotives can also last for the same period. To this end, the auxiliary drive tender also stores and transfers lubrication oil, water, and traction sand in proportionate quantities. Tank, 126, holds approximately 2,600 gallons of lubrication oil for use by the locomotives. Similarly, tank, 130, provides storage for approximately 2,600 gallons of water.

The center tank, 128, holds approximately 288 cubic feet of sand. Note that it is configured as a hopper with steeply slanted lower walls to assist the flow of the sand. The shape of the adjacent fluid tanks, and even the main fuel tanks have been adjusted to accommodate this shape. Clearly other configurations could be used, such as triangular cross section tanks for the oil and water, positioned below the angled walls of the sand hopper, providing for more conventional straight ended fuel tanks. The sand tank is also pressurized with air to improve the flow of sand. In this manner, when the discharge valve is opened, a combined flow of sand and compressed air travels out of the tank and through the pipes and hoses of the discharge connections. This provides significantly improved sand flow and enables significant transfer distances using simple pipe and hose connections. In an alternative embodiment, the sand may be stored in two separate hoppers, one at each end of the tender. This reduces the transfer distance to the near locomotive and places the weight of the sand directly over the drive axles. However it may result in a load imbalance if the sand is consumed at unequal rates from the two hoppers and increases the transfer distance to the far locomotive where both hoppers will still feed both locomotives.

Tanks, 110 on FIG. 2 provide storage for compressed air generated by the locomotives. This air is used locally by the tender for actuation of the braking system, the traction motor controls, and the tender's sand hoppers as well as to drive the various pumps used to transfer the stored liquids and to pressurize the sand hopper and transfer the sand. In the preferred embodiment, these tanks are the same as are fitted to a conventional locomotive. Alternatively, oversized air reservoirs can be applied to the tender for specialized service requirements. If needed the locomotives can also draw on this stored air for their own use.

The quantities discussed above and used in the preferred embodiment were established for a typical configuration and use pattern. Different locomotives, patterns of use, geographic terrain, or other factors may require different proportions. These may be adjusted during design and manufacturing as required to meet different applications.

Transfer

The auxiliary drive tender is equipped to transfer the stored materials to either of the locomotives to which it is coupled. This is done by a set of couplings which are in addition to conventional MU connections. These are shown schematically in FIG. 5. Conventional fluid and product valves may be installed at the pilots to secure against spills or leakage when the tender is uncoupled from the locomotives. E.g. Monroe valve CC-4002-2.5 or CC-4002-3 could be used for the sand hoses.

As discussed above, pipes 134 and 136 provide an open connection between the two main tanks, 124 and 132, and the belly tank, 104. The belly tank is then connected by pump, 138, and valve, 140, to fluid connection, 118. The preferred embodiment of the fluid connection is a rigid pipe of appropriate diameter which runs the length of the tender. Both ends connect to a standard flexible coupling which provides the connection to the adjacent locomotive. The pump and valves are industry standard compressed air driven components. On the locomotives the fuel may be routed either to the fuel tank or directly to the engine for use. Routing directly to the engine allows the local storage tanks to serve as a reserve.

In a similar manner, lubrication oil tank, 126, connects to fluid connection, 122, via pump, 142, and valve, 144. Water tank, 130, connects to fluid connection, 120, via pump, 146, and valve, 148. As with the fuel connections, the lubrication oil and water fluid connections comprise rigid pipe and flexible couplings for each of the locomotives in the preferred embodiment. Each of these pumps and valves is an industry standard compressed air driven component.

As discussed above, the traction sand in hopper, 128, is not pumped. Rather, the tank is pressurized to approximately 125 psi and when valve, 150, is opened the flow of compressed air moves the sand through line, 116. In the preferred embodiment, a Monroe Type PA Quick-Acting dry sand Shut-off vale, model number CC-4013-2.5 or CC-4002-3, is used. Other pressures and other valves would be applicable to meet other design constraints. Flexible couplings provide the connection to the locomotives. In the preferred embodiment, the sand is directed straight to the discharge chutes for application to the track. This configuration has the advantage of allowing the locomotives to first draw on the supply of sand in the auxiliary drive tender, keeping their own sand hoppers full. In this way, the hoppers on the locomotives act as a reserve which is used only when the tender hopper is empty. This provides a reserve quantity with which the locomotive crew is very familiar, having the same capacity as a locomotive which operates without a tender. In this configuration, dual sand connections are provided at the pilots, one for each side of the locomotive. If preferred, the sand may be transferred to the sand hoppers in the locomotives and then distributed conventionally. Additional lines, not shown, can also transfer sand from the bulk hopper, 128, to the tender's own sand delivery lines leading directly to the tender's discharge chutes.

Compressed air tanks, 110 in FIG. 2, connect to the air brake supply line which is part of the normal MU connections and are filled by the compressed air supplied by the locomotives. Lines are then run to the tender's brakes, actuation controls, and pumps in a conventional manner.

In addition to the above connections, the auxiliary drive tender also provides connections for conventional MU operations. These would include: prime electrical power; fuel delivery lines; air brake supply for train car brakes; air hose for traction motor control actuation; air hose for actuation/reduction of locomotive brakes; air hose for application and release of locomotive air brakes; and air hose for actuation of sand hoppers. All of the above valves and pumps are controlled from the locomotives via electrical or air control lines, as appropriate, similar to MU operations. All of the above lines would terminate at mountings on each pilot, 114, laterally adjacent to the couplers.

Auxiliary Drive

The auxiliary drive tender does not serve solely as a tender, storing and supplying consumable materials but is also an active member of the locomotive consist, providing additional drive axles which are powered by the generators on the locomotives. This is far more practical because of the weight of the materials which the tender carries. Significant weight is required in order for the drive axles to have sufficient traction to provide driving force. In the switchyard "slugs" this is provided by concrete ballast. That approach is impractical for long haul applications because the ballast is dead weight. It is not paying freight, and does not provide anything of value to the locomotives. However, it does consume power to move it. Combining the tender and auxiliary drive functions supplies the needed weight as something of value to the locomotives: necessary consumables which increase their range.

The drive function is provided by conventional traction motors coupled to drive axles as would be found in locomotives. In the preferred embodiment, two trucks with three axles each are used, similar to a locomotive. The traction motors are A/C and develop 2400 to 3200 hp in combination. In the preferred embodiment one engine at a time provides power to the traction motors. While either engine may be used, only one is active at a time. Alternatively, the tender could be configured so that each engine drives only the traction motors located in the truck at the same end of the tender, with optional switching to allow a single engine to drive all traction motors as above. A further alternative would have both engines providing power to a distribution circuit which then distributes the available power to the traction motors. Further alternative configurations could clearly be used and would be apparent to a person of ordinary skill in the field.

Dynamic Braking

Figure 6:
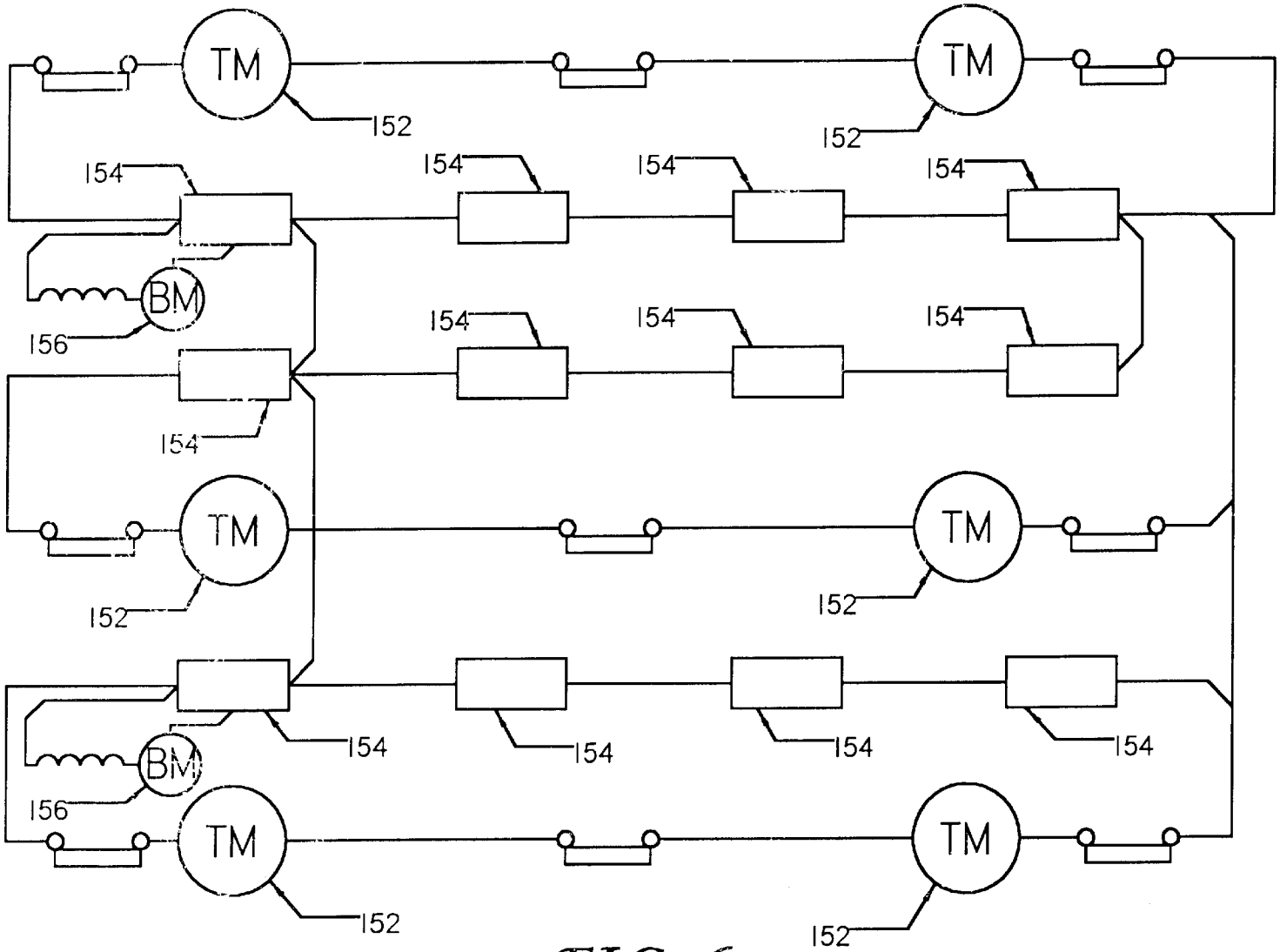
FIG. 6 is a wiring diagram for a typical dynamic braking configuration.

The auxiliary drive tender is also equipped for dynamic braking much as would be a conventional locomotive. Under command of the lead locomotive, the tender's traction motors can be converted to function as electrical generators and thereby used to convert kinetic energy to electric energy. The power distribution circuitry is switched to direct the generated current through the resistance grids, 154, located on top of the tender under vents, 106. The grids dissipate the current as waste heat. Such dynamic braking circuitry is common in the industry and is well understood by those of ordinary skill. One possible dynamic braking circuit is shown in FIG. 6. Traction motors, 152, are electrically coupled to resistance grids, 154. Blower motors, 156, drive blowers which force air across the grids for cooling.

The inclusion of dynamic braking in the auxiliary drive tender is important to balance the increased drive capability provided. The increase in driving force available means that the same number of locomotives are capable of pulling a larger train. Without additional dynamic braking, the locomotives may not be able to effectively slow that train. This would result in increased wear and reduced alternatives available to the train crew. The dynamic braking provided by the auxiliary drive tender matches the dynamic braking capability to the increased drive capability making the train equally manageable in deceleration.

Advantages

The auxiliary drive tender of the present invention provides significant advantages to train operators, especially those in the long haul freight business. Some of these are a direct result of the increased capability and range while others are indirect, but no less significant. The auxiliary drive tender disclosed herein has the potential to alter the infrastructure and business methods of all present long haul train operators, having an impact measured in millions of dollars.

One set of direct savings results from the ability to increase the freight tonnage hauled with the same number of locomotives, which results from the auxiliary drive functionality of the auxiliary drive tender. Rather than adding a third locomotive to a consist to provide the necessary pulling force for a train, an auxiliary drive tender can be added, drawing on the excess current generated by one or two locomotives to provide additional tractive force at a fraction of the cost. An auxiliary drive tender is anticipated to cost approximately ½ to ⅔ of the cost of a new locomotive. In addition, maintenance and repair costs will be significantly lower, since neither engine nor generators need to be maintained.

Another direct cost savings results from the increased range which results from the storage and supply functionality of the auxiliary drive tender. The increased capacity provided more than triples the range of a train. With a conventional locomotive consist, a trip from Chicago to Los Angeles would require a mid-trip stop for locomotive service, in each direction. Where the locomotives must be uncoupled and moved to a roundhouse or service area for servicing this stop may delay the train for up to 12 hours. Even with DTL servicing, several hours may be lost. Either way, significant fuel is consumed (as well as increased wear incurred) stopping and restarting the train. With an auxiliary drive tender for every two locomotives, the mid-trip service stop can be eliminated. The lost time, wasted fuel, and wear and tear are all eliminated as the train travels straight through. Non-stop trans-continental freight hauls are even possible.

Significant indirect savings also result from the increased capacity of the auxiliary drive tender. The increased range significantly increases the options available for fuel management. With current locomotive ranges, fuel must be made available at service points along a long haul route. This means that either the fuel must be purchased locally at market rates or purchased elsewhere and transported, increasing the costs. Fuel costs can vary as much as 10%–20% along a long haul route.

The range available with an auxiliary drive tender is such that many long haul routes can be traveled round trip without refueling. An example is the above Chicago to Los Angeles trip which could be made, round trip, without refueling. An immediate consequence is that all fuel can be purchased a single location. Rather than being at the mercy of local markets, the long haul operator will have the option of purchasing fuel only at the least expensive location along the route. This savings alone can be $1500.00 per trip. With increased volume purchasing in that market, further cost savings can probably be realized through discounted prices.

Secondary savings result in the elimination of logistical support related to providing fuel at multiple points along the route. Transportation costs to move the fuel can be eliminated. Fixed fueling facilities which are currently maintained by, or for, the long haul operators will no longer be needed. This will result in reduced labor costs for mechanical, labor, hostler and other service personnel as well as reduced costs associated with the facility itself. Service costs for DTL fueling can also be reduced or eliminated.

While the preferred form of the invention has been disclosed above, alternative methods of practicing the invention are readily apparent to the skilled practitioner. The above description of the preferred embodiment is intended to be illustrative only and not to limit the scope of the invention.

We claim:

1. Where it is desired to increase the range and tractive force of a locomotive, having an electric power source, an auxiliary drive tender comprising:

(a) at least two trucks, each comprising at least two drive axles, driven by one or more traction motors;

(b) a structural frame, connected to and supported by said trucks;

(c) means, attached to at least one end of said frame, for physically coupling said auxiliary drive tender to the locomotive;

(d) means for electrically coupling said traction motors to the electric power source on the locomotive;

(e) fuel storage means attached to and supported by said frame; said fuel storage means comprising at least three storage tanks, a first of said tanks being positioned below and in fluid communication with the other two of said tanks; and (f) fuel transfer means coupled to said first tank and adapted to transfer fuel to the locomotive.

2. Where it is desired to increase the range and tractive force of a locomotive, having an electric power source, an auxiliary drive tender comprising:

(a) at least two trucks, each comprising at least two drive axles, driven by one or more traction motors;

(b) a structural frame, connected to and supported by said trucks;

(c) means, attached to at least one end of said frame, for physically coupling said auxiliary drive tender to the locomotive;

(d) means for electrically coupling said traction motors to the electric power source on the locomotive;

(e) fuel storage means attached to and supported by said frame; and (f) fuel transfer means, coupled to said fuel storage means, and adapted to transfer fuel to the locomotive; and (g) communication means whereby the locomotive transmits commands to said tender and wherein said traction motors and said fuel transfer means are responsive to said commands.

3. Where it is desired to increase the range and tractive force of a locomotive, having an electric power source, an auxiliary drive tender comprising:

(a) at least two trucks, each comprising at least two drive axles, driven by one or more traction motors;

(b) a structural frame, connected to and supported by said trucks;

(c) means, attached to at least one end of said frame, for physically coupling said auxiliary drive tender to the locomotive;

(d) means for electrically coupling said traction motors to the electric power source on the locomotive;

(e) fuel storage means attached to and supported by said frame; and (f) fuel transfer means, coupled to said fuel storage means, and adapted to transfer fuel to the locomotive; and (g) lubrication oil storage means, supported by said frame, and lubrication oil transfer means, coupled to said lubrication oil storage means, adapted to transfer lubrication oil to the locomotive.

4. Where it is desired to increase the range and tractive force of a locomotive, having an electric power source, an auxiliary drive tender comprising:

(a) at least two trucks, each comprising at least two drive axles, driven by one or more traction motors;

(b) a structural frame, connected to and supported by said trucks;

(c) means, attached to at least one end of said frame, for physically coupling said auxiliary drive tender to the locomotive;

(d) means for electrically coupling said traction motors to the electric power source on the locomotive;

(e) fuel storage means attached to and supported by said frame; and (f) fuel transfer means, coupled to said fuel storage means, and adapted to transfer fuel to the locomotive, and (g) sand storage means, supported by said frame, and sand transfer means, coupled to said sand storage means, adapted to transfer sand to the locomotive.

5. The auxiliary drive tender of claim 4 wherein said sand storage means has a capacity which exceeds the amount of sand stored on the locomotive.

6. Where it is desired to increase the range and tractive force of a locomotive, having an electric power source, an auxiliary drive tender comprising:

(a) communication means whereby the locomotive transmits commands to said tender;

(b) at least two trucks, each comprising at least two drive axles, driven by one or more traction motors, said traction motors responsive to at least one of said commands;

(c) means for electrically coupling said traction motors to the electric power source on the locomotive;

(d) dynamic braking circuitry responsive to at least one of said commands, comprising at least one resistance grid, electrically coupled to said traction motors;

(e) a structural frame, connected to and supported by said trucks;

(f) means, attached to at least one end of said frame, for physically coupling said auxiliary drive tender to the locomotive;

(g) fuel storage means supported by said frame, having a capacity of at least 150% the quantity of fuel stored on the locomotive;

(h) fuel transfer means responsive to at least one of said commands, coupled to said fuel storage means, and adapted to transfer fuel to the locomotive;

(i) lubrication oil storage means supported by said frame;

(j) lubrication oil transfer means responsive to at least one of said commands, coupled to said lubrication oil storage means, adapted to transfer lubrication oil to the locomotive;

(k) sand storage means supported by said frame, having a capacity which significantly exceeds the quantity of sand stored on the locomotive;

(l) sand transfer means responsive to at least one of said commands, coupled to said sand storage means, adapted to transfer sand to the locomotive;

(m) water storage means supported by said frame;

(n) water transfer means responsive to at least one of said commands, coupled to said water storage means, adapted to transfer water to the locomotive.

7. The auxiliary drive tender of claim 6 wherein said frame has a longitudinal midpoint and wherein said sand storage means has a center of mass and said sand storage means is positioned with said center of mass substantially directly above said frame midpoint.

8. The auxiliary drive tender of claim 7 wherein said fuel storage means comprises two storage tanks of substantially equal capacity and are disposed symmetrically relative to said longitudinal midpoint.

9. The auxiliary drive tender of claim 8 wherein said fuel storage means further comprises a third tank, positioned below and in fluid communication with the first two of said tanks, and wherein said fuel transfer means is coupled to said third tank.

10. Where long range, non-stop operation is desired, a mixed locomotive consist comprising:

(a) a first and a second locomotive each having an engine and an electric generator driven by said engine;

(b) an auxiliary drive tender, positioned between and physically coupled to said first and second locomotives, said tender comprising:

(i) communication means whereby a first of said locomotives transmits commands to said tender;

(ii) a structural frame;

(iii) at least two trucks, connected to and supporting said frame, each comprising at least two drive axles, driven by one or more traction motors, said traction motors responsive to at least one of said commands;

(iv) dynamic braking circuitry responsive to at least one of said commands, comprising at least one resistance grid, electrically coupled to said traction motors;

(v) means for electrically coupling said traction motors to the electric generator on at least one of said locomotives;

(vi) fuel storage means attached to and supported by said frame; and (vii) fuel transfer means responsive to at least one of said commands, coupled to said fuel storage means, and adapted to transfer fuel to both of said locomotives;

(c) said first and second locomotives adapted to receive fuel from said tender while underway.

11. The locomotive consist of claim 10 wherein said auxiliary drive tender further comprises means for storing lubrication oil, sand and water and means for transferring said lubrication oil, sand and water to both of said locomotives and said locomotives have been adapted to accept at least one of said lubrication oil, sand and water from said tender.

12. The locomotive consist of claim 11 wherein said locomotives further comprise local fuel storage and a fuel distribution circuit, said circuit adapted to accept fuel from said tender and supply it directly to said engine, bypassing said local storage.

13. The locomotive consist of claim 10 wherein said means for electrically coupling said traction motors on said auxiliary drive tender is electrically coupled to both of said locomotive generators and further comprises a power distribution circuit having the capability to select one of said generators to supply power to all of said traction motors.

14. The locomotive consist of claim 13 wherein said tender power distribution circuit further comprises the capability to electrically isolate said traction motors of a first of said trucks from said traction motors of a second of said trucks and to route power from a first of said locomotive generators to said traction motors of said first truck and from a second of said locomotive generators to said traction motors of said second truck.

15. The locomotive consist of claim 13 wherein said tender power distribution circuit further comprises the capability to receive power from both of said locomotive generators simultaneously and route said power to all of said traction motors.

* * * * *